United States Patent [19]

Cottle, Jr. et al.

[11] Patent Number: 4,500,051

[45] Date of Patent: Feb. 19, 1985

[54] GYRO STABILIZED OPTICS WITH FIXED DETECTOR

[75] Inventors: Wilbur W. Cottle, Jr.; Lilburn R. Smith, both of Richardson, Tex.

[73] Assignee: Texas Instruments Incorporated, Dallas, Tex.

[21] Appl. No.: 575,684

[22] Filed: May 8, 1975

Related U.S. Application Data

[62] Division of Ser. No. 295,746, Oct. 6, 1972, abandoned.

[51] Int. Cl.[3] ..... F41G 7/22

[52] U.S. Cl. ..... 244/3.16

[58] Field of Search ..... 244/3.16, 3.17, 3.18, 244/3.21, 3.27, 3.29

[56] References Cited

U.S. PATENT DOCUMENTS

| | | | |
|---|---|---|---|
| 3,756,538 | 9/1973 | McLean | 244/3.16 |
| 3,920,200 | 11/1975 | Evans et al. | 244/3.16 |
| 4,003,655 | 1/1977 | Wasilko | 244/3.16 |
| 4,006,356 | 2/1977 | Johnson et al. | 244/3.16 |
| 4,009,393 | 2/1977 | Ashley, Jr. et al. | 244/3.16 |
| 4,009,848 | 3/1977 | Albert et al. | 244/3.16 |
| 4,010,365 | 3/1977 | Meyers et al. | 244/3.16 |

*Primary Examiner*—Charles T. Jordan
*Assistant Examiner*—Thomas H. Webb
*Attorney, Agent, or Firm*—Alva H. Bandy; Leo N. Heiting; Melvin Sharp

[57] ABSTRACT

A cannon launched guided projectile having a gyro based electro-optical target finding and guidance system which includes an optical system carried by a gyro to provide target location information for an electronic system to produce gyro rotor torquing signals and for producing projectile guidance signals from gyro pickoff outputs is disclosed. The electronics system includes two difference channels for processing pitch and yaw signals responsive to the electrical output of a light detector and a sum channel for controlling the two difference channels responsive to target acquisition and master trigger signals.

9 Claims, 23 Drawing Figures

Fig. 3
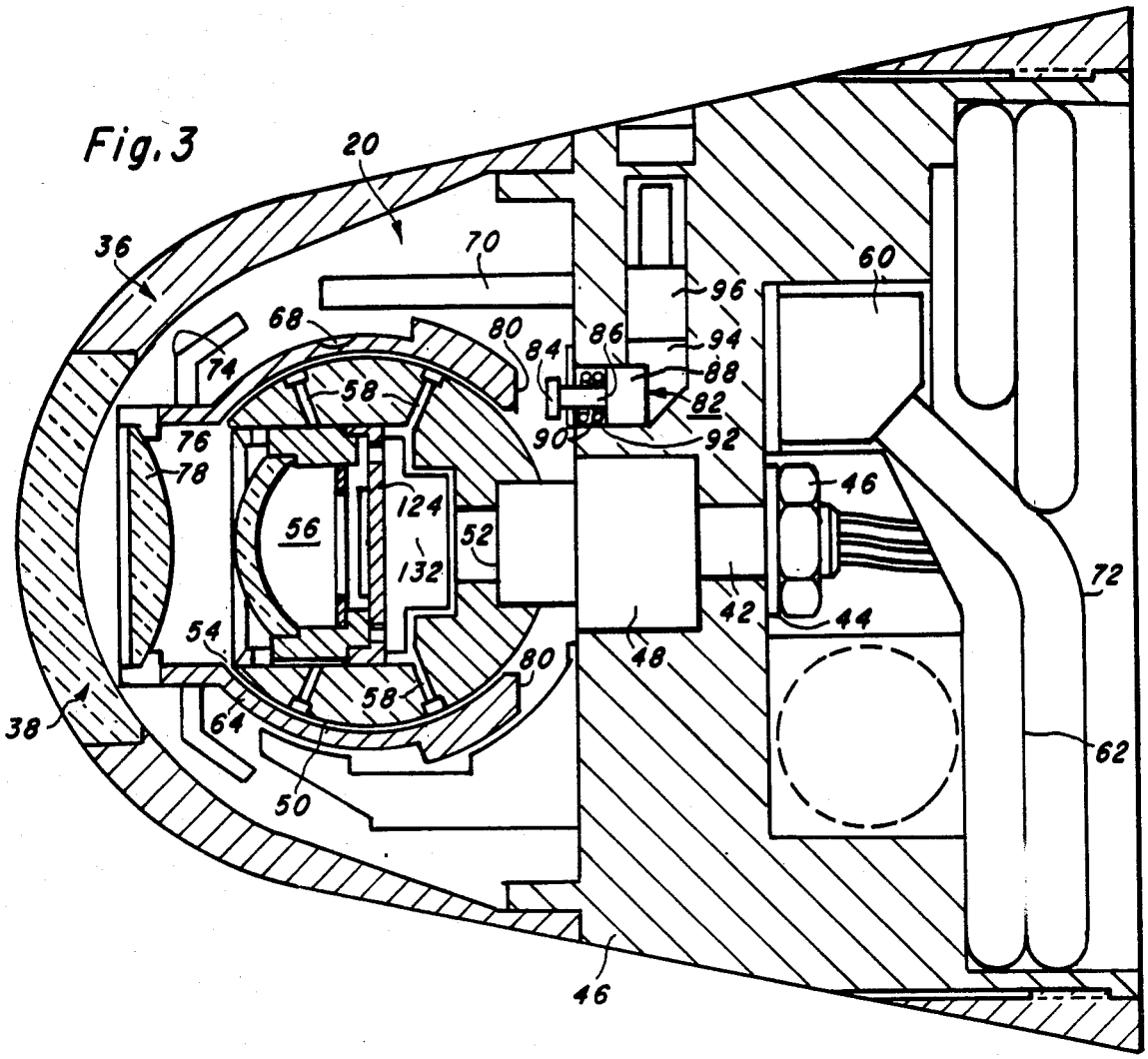
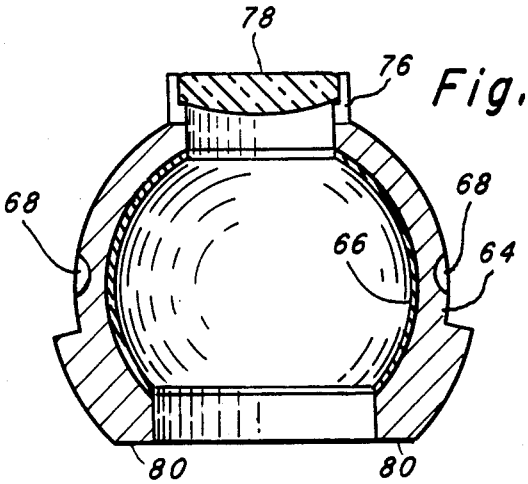
Fig. 4

Fig. 5
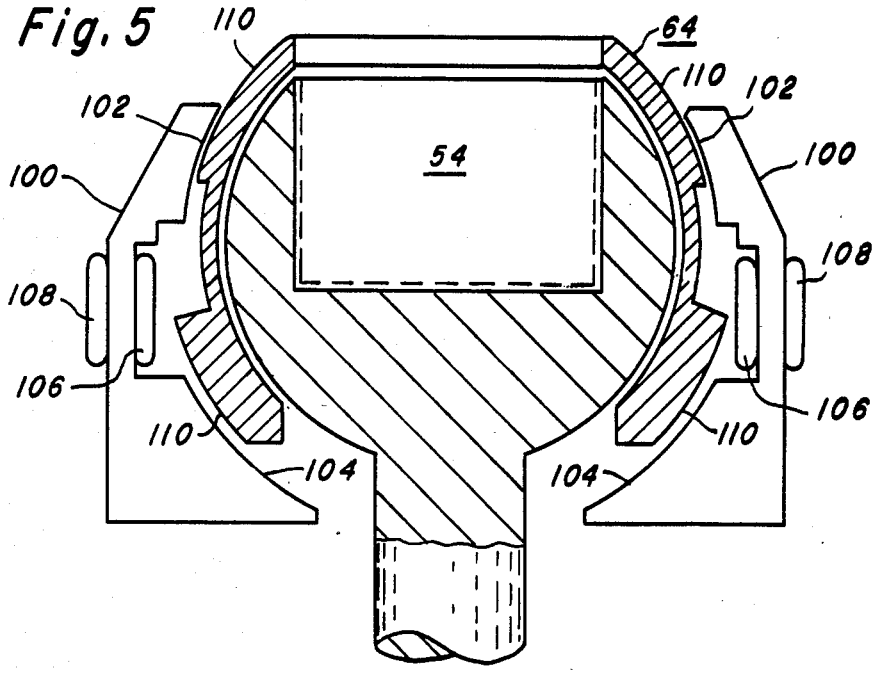
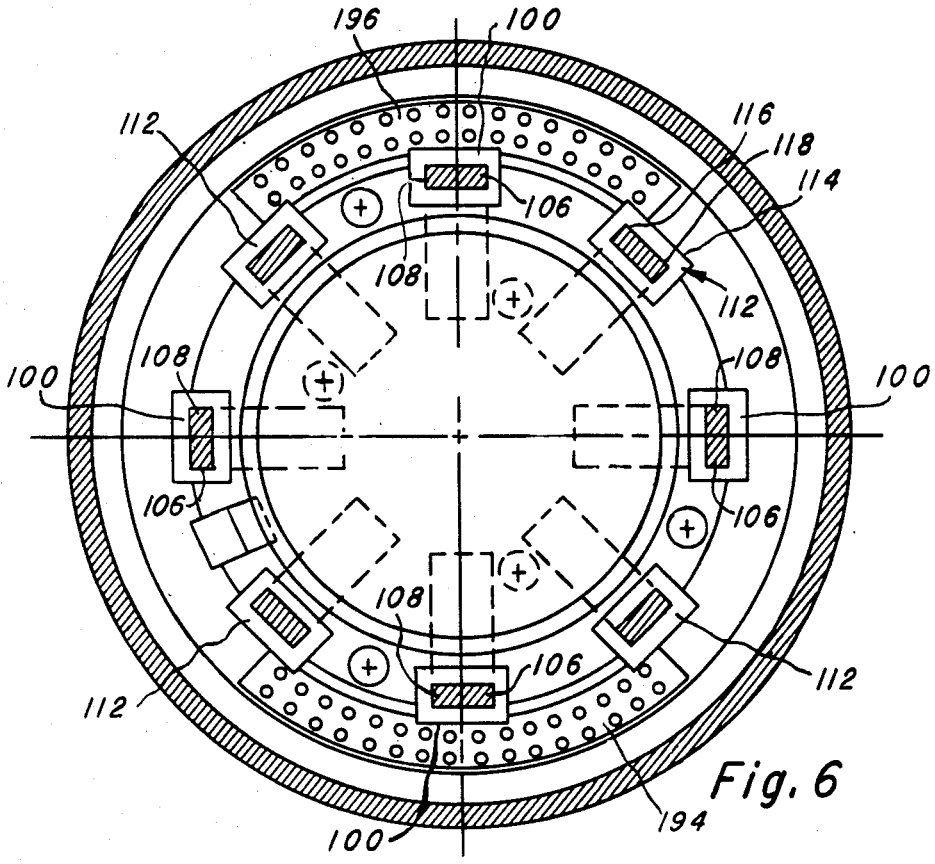
Fig. 6

Fig. 7
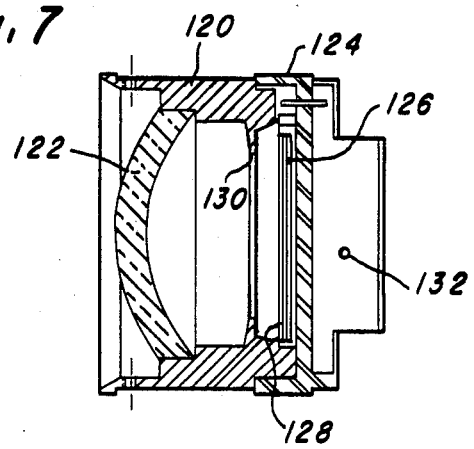
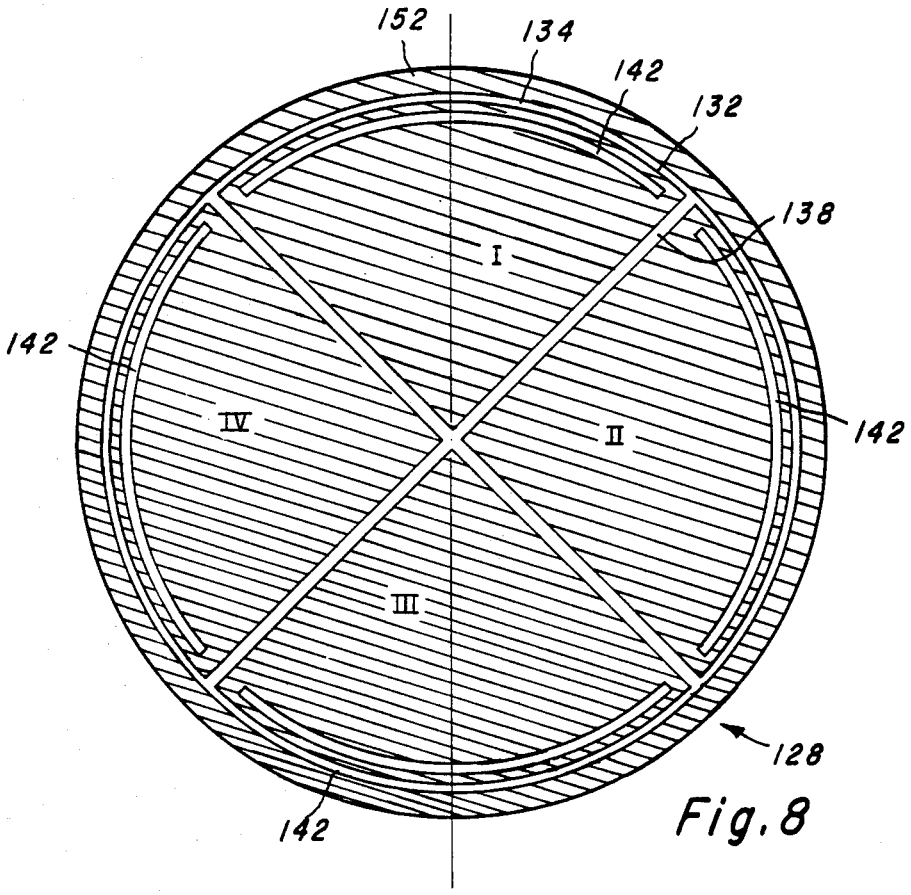
Fig. 8

GYRO STABILIZED OPTICS WITH FIXED DETECTOR

This is a division of application Ser. No. 295,746, filed Oct. 6, 1972 now abandoned.

This invention relates to a cannon launched guided projectile and more particularly to a gyro based electro-optical guidance system therefor. Thus, although the invention is illustrated and described in detail herein as being applied to a target seeking ground-to-ground type projectile, it will be appreciated that the method and means of the present invention are equally applicable to guide any other mechanical device to follow any desired light illuminated pattern.

Many different types of target seeking systems are known to and have been employed in the homing guided missile art, as for example, heat radiation emanating from the target, sound waves emanating from the target, light reflection from the target to distinguish it from the background, and radio frequency electromagnetic energy which is transmitted from the missile or a remote transmitting station and the reflections (echoes) from a target being received by the missile sensing system. However, the signal-responsive and directional control mechanisms heretofore provided in the missile art have invariably possessed certain inherent shortcomings and disadvantages because the structures are fragile, highly complex and bulky. Thus, the prior art guidance systems are expensive to manufacture and have size limitations prohibiting their use in projectiles such as cannon launched projectiles.

It is an object of this invention to provide a simplified guidance system in accordance with an improved guidance technique.

It is another object of this invention to provide a light weight guidance system package which is compact in size.

It is still another object of this invention to provide a guidance system which is inexpensive and economical to produce.

It is also another object of this invention to provide a cannon launched guided projectile.

It is a further object of this invention to provide a gyro-optical assembly which minimizes the length and weight of the assembly and has only one moving part.

It is yet another object of this invention to provide a guidance system capable of withstanding high inertial forces resulting from high acceleration rates generated during launch by firing the shell.

Briefly stated this invention provides a compact electronic guidance system responsive to the output of a target seeking gyro-optical assembly suitable for inclusion in the nose cone of a typical cannon projectile to provide a cannon launched guided projectile. The gyro-optical assembly is responsive to light reflected from a target by a light amplification by stimulated emission of radiation (laser) device to produce electrical signals indicative of target location for an electronic guidance system.

These and other objects and features of the invention will become more readily understood in the following detailed description taken in conjunction with the drawings:

FIG. 3 is an enlarged sectional view showing in greater detail the gyro-optical assembly of the guidance system;

FIG. 4 is a cross-sectional view of the gyro-rotor for the gyro-optical assembly;

FIG. 5 is a vertical view partly in section of the gyro-stator and including a schematic view of the torquer;

FIG. 6 is a cross-sectional view of the gyro-optics assembly taken along the spin axis of the gyro to show the arrangement of the torquers and pick-offs;

FIG. 7 is a cross-sectional view of the detector assembly for the gyro-optical assembly;

FIG. 8 is a front view of the detector of the detector assembly;

FIG. 18*a*–18*f* are collectively a detailed block diagram of the guidance system.

Figure 1:
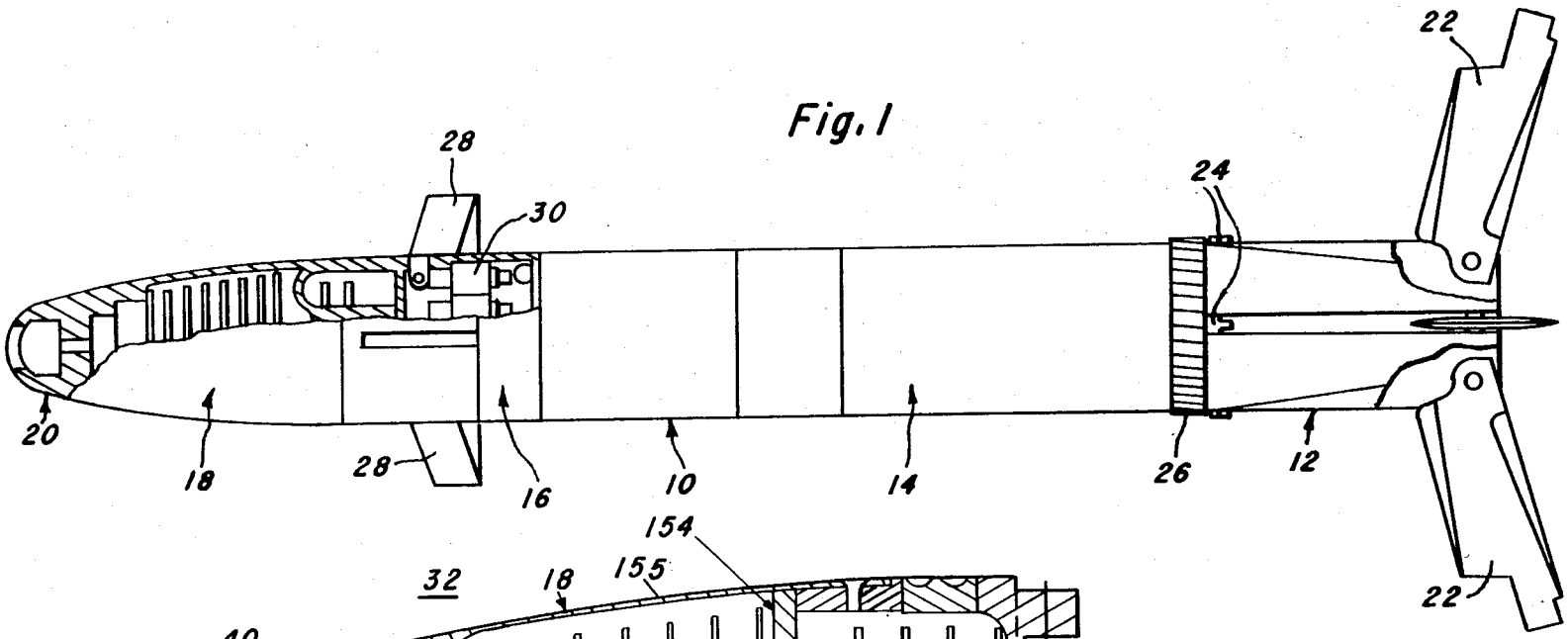
FIG. 1 is a side view with a portion of the surface broken away to show the internal and external layout of a cannon launched guided projectile.
Figure 2:
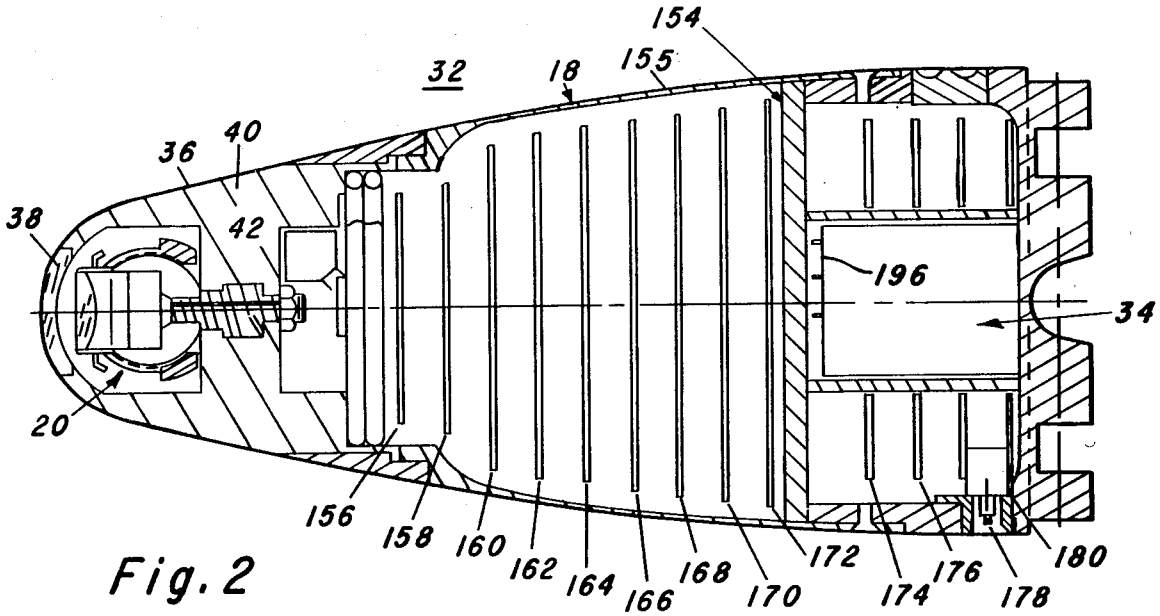
FIG. 2 is an enlarged sectional view of the gyro-optical assembly and electronic sections of the projectile of FIG. 1.

Referring to the drawings, the cannon launched guided projectile construction of the present invention comprises (FIG. 1) a tubular housing 10 having a stabilization section 12 at one end or the aft end, and proceeding from the aft end to the forward end a payload section 14, a control section 16, an electronics section 18, and a gyro-optical section 20. The stabilization section 12 includes a plurality of stabilizing fins 22 which in the firing position are held flush with the housing 10 by friction latches 24. When the projectile is fired a slipping obturation band 26 seals the projectile against the interior of the cannon barrel (not shown) to prevent the escape of propulsion gases. When the spinning projectile leaves the cannon barrel the centrifugal force overcomes the friction force of the latches 24 and the stabilizing fins 22 are deployed to stabilize the projectile in flight. The payload section 14 may be, for example, that of a typical high explosive 155 mm howitzer shell. The control section 16 includes a plurality of canards 28 which are actuated by servo actuators 30. The servo actuators 30 are actuated by the output signals of a guidance system 32 (FIG. 2).

The guidance system (FIG. 2) is housed in the gyro-optical assembly section 20 and the electronics section 18 which includes an electrical power section 34. The gyro-optical assembly section 20 (FIG. 3) includes a cone shaped housing 36 having a dome 38 in its apex. The housing 36 may be constructed of any suitable material such as aluminum, steel, or brass and the dome 38 may be constructed of either glass or plastic. The dome 38 must be transparent to light for passing light reflected from a target illuminated by a laser beam, and in addition must be capable of withstanding heat generated during firing and flight and all types of precipition which may be encountered during flight. Sapphire, Vycor, a 96% silica glass manufactured by Corning Glass Co., or Cortran 9753, an alumina-silicate glass also manufactured by Corning Glass Co., are suitable materials for the dome 38. A bulkhead 40 is provided adjacent the base of the housing 36. A bolt 42 (FIG. 3) passes through the center of the bulkhead 40 along the longitudinal axis of the projectile. The bolt 42 is secured to the bulkhead by a lock washer 44 and nut 46 and is prevented from rotational movement by a square or other suitably shaped boss 48 rigidly attached to or formed as an integral part of the bolt and seated in the bulkhead 40. The other end of the bolt 42 terminates in a spherical gyro stator or bearing ball 50. The gyro stator 50 may be integral with the end of bolt 42 or it may be rigidly secured to another square or suitably shaped boss 52 of bolt 42. The boss 52 is to prevent any rotational movement of the gyro stator 50. The latter arrangement may be preferred where the gyro stator material is not suitable for use as the bolt 42. Gyro stator 50 may be constructed of any suitable metallic material such as, for example, an alloy of Ni, Ti, Cr, C, Mn, Si, Al, and P sold under the trademark Ni-Span C by International Nickel Co. which has a coefficient of expansion less than that of the gyro rotor material hereinafter described. The gyro stator or bearing ball 50 preferably has a circularly shaped well 54, although other shapes can be employed, having its longitudinal axis coincident with the longitudinal axis of the projectile and extending from the stator surface adjacent the dome 38 inwardly past the center of the stator 50. The well 54 supports a detector assembly or system 56 hereinafter described in detail. A plurality of gas passages 58 extend from the surface of the stator 50 inwardly to the sides of well 54 (FIG. 3) and are in communication with an output of a gas valve 60 connected to gas container 62 to supply air between the surface of the stator or bearing ball 50 and a gyro stator 64.

The rotor 64 (FIG. 4) nearly surrounds the spherical stator. The inside spherical surface of the rotor 64 is coated with a high resiliency plastic film 66. The rotor 64 is made of a high permeability soft steel to permit magnetic torquing. A cobalt-iron alloy of very high magnetic saturation sold under the trademark Vanadium Permendur by Allegheny Ludlum Steel Corp. which has a temperature coefficient of expansion of $5.1\times10^{-6}$/°F. is suitable if the spherical stator is made of Ni-Span C which has a linear thermal coefficient of $4.0\times10^{-6}$/°F. The plastic film 66 for the rotor 64 may be a 0.001 inch thick epoxy resin film sold under the trademark Stycast 1090 by Emerson and Cuming Company. The rotor 64 forms with the stator 50 a very small ($5\times10^{-4}$ inches) bearing gap (FIG. 3). Since the bearing gap is small a large contact area is formed when the unsupported rotor 64 contacts the spherical stator or ball support 50 during "setback" which occurs when the projectile is fired. The result is a very low film stress with no permanent deformation in the rotor 64 or stator 50. When the gyro rotor 64 is levitated by air passing through the gyro stator gas passages 58, the centers of the rotor 64 and stator 50 are concentric.

To spin up the rotor (FIG. 3), a plurality of cavities 68 are formed about the equatorial section of the rotor 66. These cavities 68, referred to as "buckets", are designed to receive gas jets for spin-up of the rotor 64. A plurality of spin-up tubes 70 are supported by the bulkhead 40. The spin-up tubes 70 are connected to another output of valve 60 which receives gas from the spin up gas storage container 72. Orifices are provided adjacent the end of the spin-up tube for directing gas against the "buckets" 68 of the rotor 64 to bring the rotor 64 to full speed. The gyro rotor 64 is provided with a plurality of spin sustainer ports 74 located adjacent the rotor's forward end. Gas from the container 62, which is utilized for the bearing stator 50, is also used for sustaining the spin of the rotor 64. A lens holder 76 (FIGS. 3 and 4) is formed on the forward end of the rotor 64. The lens holder 76 may be of any suitable material; however, an aluminum holder is preferred. A lens/filter 78 is mounted in the lens holder 76 for rotation between the detector assembly 56 mounted in the stator hole or well 54 and the housing dome 38 which together constitute an optical system hereinafter described.

To cage the gyro (FIG. 3) the end 80 of the gyro rotor 64 opposite the lens holder end is used with a plurality of caging assemblies 82 mounted in the bulkhead 40. Each caging assembly 82 includes a caging surface plate 84 connected to one end of tubular stem 86 and having a gas outlet passage in communication with the tubular stem. A piston 88 is connected to the other end of the tubular stem 86. A helical spring 90 surrounds the tubular stem 86 intermediate the piston 88 and caging surface plate 84. The piston 88 is seated in a cylindrical passage 92 which is nornal to one end of a second passage 94. The second passage 94 has its end adjacent the piston 88 in communication with the gas valve 60. A key 96 located in passage 94 is used: to retain the piston within its cylindrical passage, to keep the spring 90 compressed, and to maintain the caging surface 84 against the rotor 64 to cage the gyro. To uncage the gyro, gas from the spin-up gas storage container 72 is admitted through the valve 60 to passage 94. The force of the gas drives the key 96 to the end of passage 94 opposite the piston 88, and retains the piston in the caged position while admitting air through the tubular stem 86 to lubricate the caging plate surface 84 during spin-up. After spin-up the valve 60 is closed and with the loss of gas pressure in passage 94 the compressed spring 90 drives the piston 88 into the chamber 94 to retract the caging surface 84. The end of passage 94 adjacent the piston 88 is beveled to form a stop to control piston penetration into the passage 94; the other end is in communication with the outside of the projectile to permit an operator to manipulate the key 96 with compressed air to force the key 96 into engagement with the piston 88 to cage and recage the gyro during test. Gas admitted into the housing 36 during gyro operations is permitted to escape through a bulkhead passage in bulkhead 40 to a pressure release valve (not shown) located in the housing 10 adjacent the outer side of bulkhead 40.

Control of the pointing or line of sight direction of the gyro-optical system, hereinafter described in detail, is provided by electro-magnetic torquing of the gyro about either of its two input axes (FIGS. 5 and 6). Four torquing electro-magnets or stators 100 are located at 90° angular increments around the rotor 64. The four electro-magnets 100 form two sets of torquers with each set comprising diametrically opposite electro-magnets. When dc current is applied, a torque is created to cause the gyro rotor 64 to precess at a controlled rate (10 degrees/sec.) about a desired axis. The four electromagnets 100 have cores constructed, for example, from a nickel-iron alloy sold under the trademark Allegheny-Ludlum 4750. Each electro-magnet core has two pole faces 102 and 104 and a pair of coils 106 and 108 (shown functionally in FIG. 5) wound between the pole faces. The length of each pole face 102 and 104 is designed to be approximately equal to the maximum torquer excursion. The pole pieces 102 and 104 are also separated by a distance equal to the maximum torquer excursion. Coil 106 is used as an excitation coil and coil 108 is used as a control coil. By applying dc current to one of the excitation coils 106 of an electro-magnet 100, a flux field is developed such that magnetic energy is stored in the gap between the electro-magnet 100 and pole faces 110 of the rotor 64. At the null of the gyro, the relative position of the rotor 64 with respect to the electro-magnet 100 is such that one half of each rotor pole face 110 is covered by each stator or electro-magnet pole face 102–104. At all positions of the rotor 64, including the null position, the gradient of energy stored in the gap gives rise to a force in the tangential direction to the rotor. The pole faces 102, 104 are constrained in alignment in the X direction. The degree of alignment in the Z (spin axis) direction is a function of the instantaneous angular displacement of the rotor 64. In the Y direction, the gap between the pole faces 102, 104 of the electromagnet and pole faces 110 of the gyro rotor in the overlap region is two to three times smaller than any other gaps in the assembly so that the flux is concentrated between the pole faces except for any leakage flux. To produce a bidirectional force and to linearize the torquer scale factors, two oppositely disposed electromagnets or torquers 100 are electrically coupled as follows to form one set. The excitation coil 106 (FIG. 6) of one electro-magnet is connected in series with the excitation coil 106 of the opposite electro-magnet to form one coil assembly; applying a dc current to these coils provides forces on either side of the rotor assembly which are equal in magnitude. The moment of these forces is zero since each force is in a direction to align the faces and, thus angularly oppose. The control coils 108 of these two electromagnets are also connected in series as a coil assembly such that current through the coils 108 produces flux in one assembly which adds to the flux already present, while in the opposite assembly the flux is decreased. The forces produced by these fluxes are likewise unbalanced thereby producing a moment or torque in the direction to produce rotation about a gyro input axis. By so connecting the remaining two torquers to form a second set, a moment or torque is produced in another direction to produce rotation about another gyro input axis. These two sets receive line of sight to target error signals to precess the gyro rotor 64 about pitch (Z) and yaw (Y) axis to keep the lens/filter 78 carried by the gyro rotor normal to the line of sight to target (FIG. 3).

Gyro rotor angular position with respect to the housing 10 is obtained by two sets of electro-magnetic pickoffs 112 (FIG. 6). The construction of the pickoffs 112 are similar to the torquers 100 (FIG. 5). The pickoffs 112 (FIG. 6) are located midway between the torquers 100, offsetting the pickoff axes 45° from the torquing axes. This is resolved electronically to provide coincident axes. The two sets of pickoffs 112 comprise four electromagnets or stators 114, each stator 114 has a core with two pole faces and two coils—a primary coil 116 and a secondary coil 118 wound on the core between the pole faces. When the primary coil 116 is excited with an ac current, the ac flux passes through the core of stator 114 out one pole face, through the gyro rotor 64 (FIG. 5) and back into the stator through another pole face. This ac flux links the secondary coil 118 (FIG. 6) on the stator 114 and induces an emf across it. When the rotor 64 is displaced as to the stator 114, which occurs for angular motion about the pickoff axis, the reluctance of the flux path is changed, in turn changing the induced emf in the secondary. Because of the rotary motion about the other pickoff axis, the reluctance is increased in one pickoff and decreased in the opposite pickoff. The secondary windings of opposite pickoffs 112, which comprise a set, are connected in a bridge type circuit so that when a flux unbalance occurs, a differential emf is produced. This signal is proportional in amplitude and phase to the rotor displacement angle.

From the above description of the gyro it will be readily apparent to one skilled in the art that the gyro is a torquable, two degree of freedom, displacement gyro. It contains no gimbals, as such—the necessary freedom of movement being inherent in the design.

The detector assembly 56 (FIG. 3), which together with the lens/filter 78 and the dome 38 constitute the electro-optical system, includes a metal ring 120 (FIG. 7) having an exterior diameter substantially that of the interior diameter of the gyro stator well 54 (FIG. 5). A detector window 122 is hermetically sealed in one end (forward end) of the ring 120. The detector window 122 (FIG. 7) may be constructed of either glass or plastic; however, a hard glass window such as, for example, that sold under the trademark Corning 9010 by Corning Glassware Corp. is preferred for use with a metal ring constructed, for example, from an alloy of Fe, Ni, and cobalt sold under the trademark Kovar, as the temperature coefficients of expansion are compatible and the hermetical seal can be maintained throughout a wide temperature range. A detector supporting plate 124 is hermetically sealed to the other end of the ring 120. A ceramic substrate 126 having a detector 128 rigidly secured to one side by an epoxy resin is attached to one side of the detector support plate 124. Ring 120 is provided with a baffle ring or flange 130 which extends interiorly adjacent the detector 128 to protect the detector 128 from light reflected off the ring's interior walls. Solid state preamplifiers shown in FIGS. 3 and 7 as preamplifier package 132 are attached to the other side of the detector support plate 124.

Figure 9:
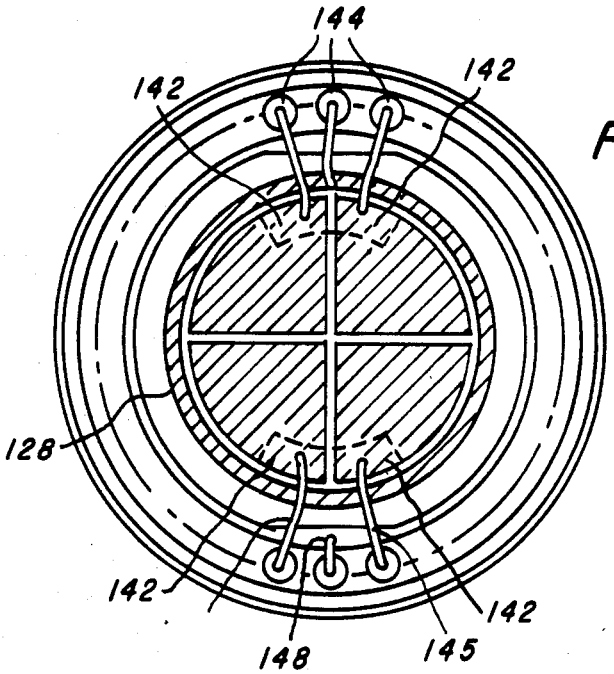
FIG. 9 is a front view of the detector assembly.
Figure 10:
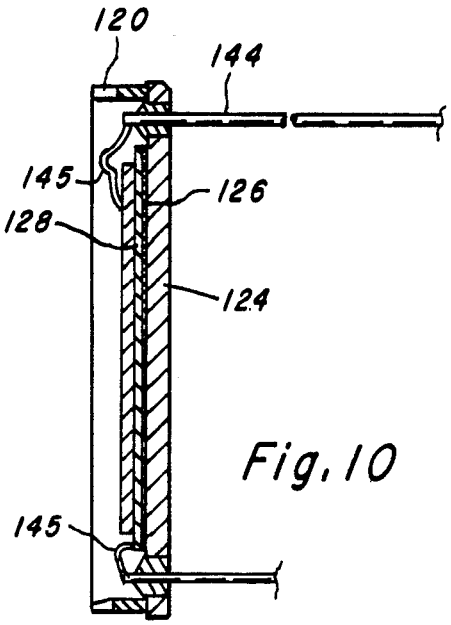
FIG. 10 is a partial side view taken in section of the detector assembly.

The detector 128 (FIG. 8) is preferably a four quadrant silicon detector having a guard ring 134 adjacent its outer periphery to minimize the effects of surface leakage. Within the guard ring 134 is the active area of the detector 128 which is divided into four equal quadrants (I, II, III, and IV) by thin (0.005 inches) mutually perpendicular dead zones 138 extending from the guard ring 134 at one side of the detector 128 through the center of the detector to the guard ring at the opposite side. The intersection or junction 140 of the thin electrical dead zones 138 at the center of the detector 128 is located on the longitudinal axis of the projectile and at the center of the stator or ball 50 (FIG. 3) of the gyro. The detector dead zone width is important only as it affects the scale factor for the angle error at the output. Each quadrant I–IV of the detector 128 is provided with a collecting electrode 142. Each electrode 142 (FIGS. 8 and 9) is electrically connected to one end of a feed through conductor pin 144 (FIGS. 9 and 10) by a fine wire aluminum conductor 145. The other end of these conductor pins 144 are connected to preamplifiers of the preamplifier package 132 (FIGS. 3 and 7)—one for each quadrant of the detector. The preamplifier package 132 may be, for example, an encapsulated package of suitable plastic, such as, for example, a polyether-based, rigid urethan plastic foam sold under the trademark Isocyanate PE 24 by Isocyanate Products, Inc. In addition feed through conducting pins 144 are provided for a guard ring lead 146 (FIG. 9) and a detector system ground lead 148.

Figure 11:
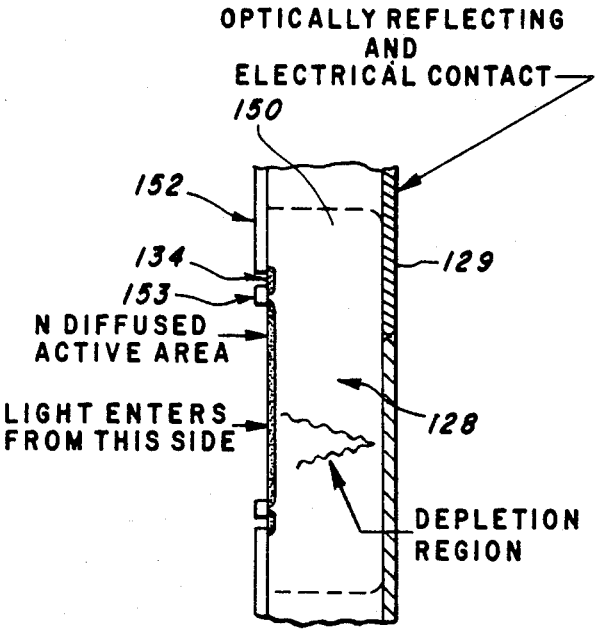
FIG. 11 is a fragmentary sectional view of the detector of the detector assembly.

The silicon detector 128 (FIG. 11) is fabricated from a P-type conductivity silicon substrate 150 having on one side an insulating layer of silicon dioxide etched away to form, by diffusion techniques well known to those skilled in the art, the N+ conductivity type guard ring 134 and the four N+ conductivity type regions which form the quadrants I–IV of the detector. The remaining silicon dioxide forms: an insulator rim 152 about the detector, the thin dead zones 138 and 140 (FIG. 8) and a barrier 153 (FIG. 11) separating from the active area from the guard ring. The opposite surface of the detector 128 is coated with a high efficiency metal reflector 129 such as, for example, gold to reflect the incident radiation back through the silicon to increase the probability that a photon will generate an electron.

The electro-optical system is to provide target location signals for processing off-target error signals. To provide a proportional off-target error signal the optical energy entering the dome 38 (FIG. 3) is defocused by the optics lens/filter 78 to a small (about 0.060 inch) blur circle on the surface of the detector 128. The electrical dead zone 140 (FIG. 8) of the detector formed by the junction of the dead zones 138 is about 0.006 inch; therefore, the reflected laser energy will impinge on 2, 3, or all 4 quadrants as the offset error is reduced. The amplitude ratio of the output signal for each quadrant will then be proportional to the lateral displacement or lateral error on the detector surface for the limited region in which more than one quadrant is stimulated. For errors greater than this, only on-off or "bang-bang" error information is available from the detector. That is, no matter what the angular difference is between the gyro spin axis and line of sight the gyro will be precessed at a constant rate.

Figure 12:
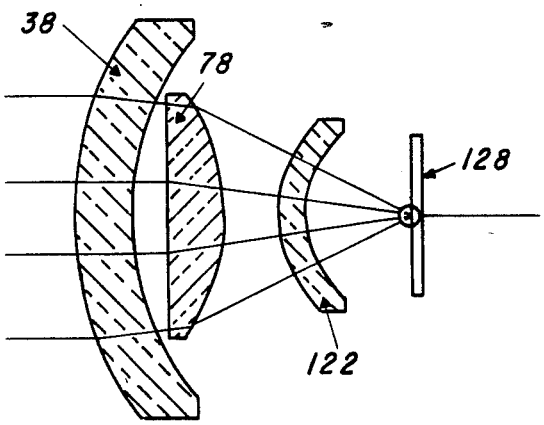
FIG. 12 is a schematic view of the aspheric optical system constituting the gyro optics.

To provide the 0.06 inch blur circle of the optical energy on the detector the radii of the surfaces encountered along the incident light path are critical for each projectile; because, the available space is limited. An example of an optical system for a 155 mm howitzer is shown in FIG. 12. The detector 128 is located at the gimbal center or center of the gyro stator 50 (FIG. 3). The dome 38 (FIG. 12) is a diverging meniscus shaped window having an outside radius of 1.425 inches from the detector and an inside radius of 1.225 inches. The dome is constructed from a polycarbonate plastic sold under the trademark Lexan 500 by General Electric Corporation which has a refractive index of 1.586. The lens of the lens/filter 78 is a plano-convex aspheric lens having an outside flat surface (infinite radius) 1.025 inches from the detector on which is formed a narrow bandpass (120 A) filter and an inside surface which is an aspheric surface having a center thickness of 0.235 inches and a basic curve radius of −0.5676 inches with aspheric terms of $A_4=0.143063$ and $A_6=5.37105$. The lens 78 is also constructed from a polycarbonate plastic such as the previously mentioned Lexan 500 and has a refractive index of 1.586. The detector assembly window 122 is a diverging meniscus window concentric about the center of the detector and has an outside radius of 0.55 inches and an inside radius of 0.46 inches. The detector window 122 is made of fused silica which has a refractive index of 1.586. The spherical aberration of this optical system produces about a 4 degree spot (0.060 diameter) on the detector 128 at the center of the field. This size spot induces the desired error signal linearity and inner loop gain. The effective spot size increases significantly for incident rays near the edge of the field of view. Some energy losses will occur with the proposed detector size; the loss amounts to approximately 10% at 12 degrees. The response falls rapidly beyond 14 degrees because of the detector baffle 130 (FIG. 7).

Figure 13:
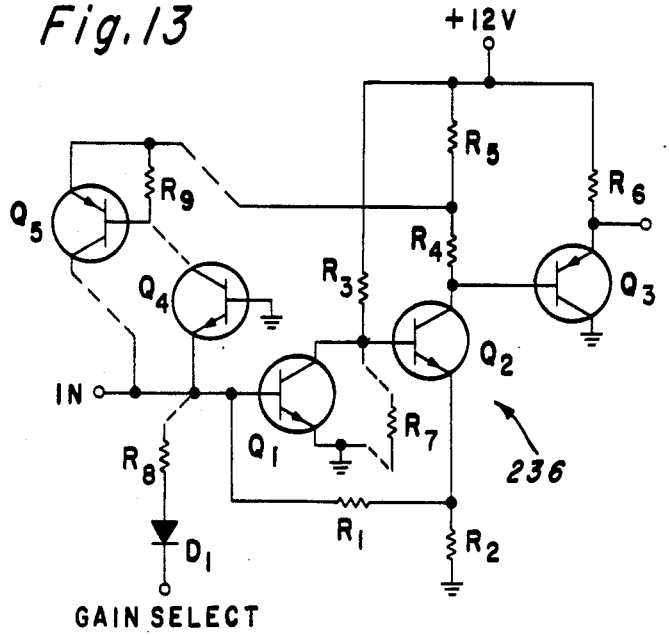
FIG. 13 is a schematic diagram of the detector's pre-amplifier circuit.

The electrical outputs of the detector's quadrants are amplified by the four preamplifiers contained in the preamplifier package 132 (FIGS. 3 and 7). Each of the four preamplifiers 236–242 (FIG. 18*a*) is constructed as shown for preamplifier 236 in the schematic circuit of FIG. 13. In this circuit when the gain select is high transistors $Q_1$ and $Q_2$ and feedback resistor R1 form a high gain transimpedance amplifier. When the gain select is low, the high gain amplifier is driven to its limits; transistor $Q_1$ is cut off and transistors $Q_4$ and $Q_5$ are turned on to form a common base stage having a load resistor R5. The output signals generated by current through R5 appears at the collector of transistor $Q_2$ and are buffered by transistor $Q_3$ for the preamplifier 236. The resistor R3 is a load resistor for the collector output of transistor $Q_1$ which output is the base bias for transistor $Q_2$. Resistor R2 is an emitter swamping resistor for the transistor $Q_2$ which together with resistor R4 provide additional gain. The output leads of the four preamplifiers pass from the preamplifier package 132 through a passage formed in the stator support bolt 42 (FIG. 3) into the electronics section 18 (FIG. 1). The high-low gain select features are to provide for the increasing strength of the reflected light target signal as the projectile approaches the target.

The electronics section 18 (FIG. 2) which houses the electrical circuits including the electronic guidance computer comprises a tapered cylinder 155 compatible with the ogive or nose cone housing 36 of the projectile to allow housing the electronics behind the bulkhead 40 of the gyro-optical assembly 20. The cylinder 155 has a bulkhead 154 adjacent its base for supporting the electronics package. The guidance system electronics is contained on a plurality of spaced printed circuit boards (156–180) stacked so that their surfaces are parallel. The completed stack is mounted on the bulkhead 154 and totally encapsulated in an epoxy potting compound.

Figure 14:
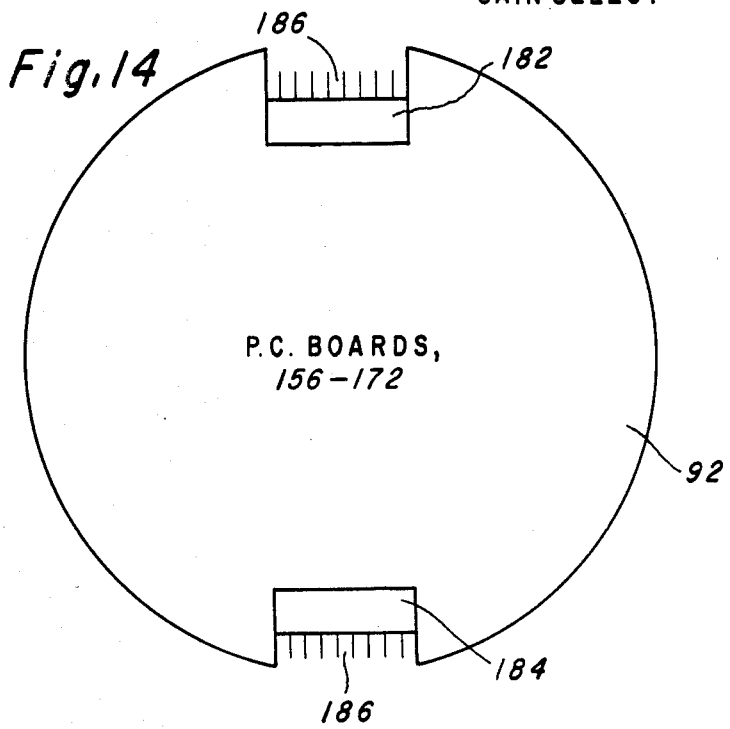
FIG. 14 is a front view of a printed circuit board used in the electronics section.

The printed circuit boards 156–172 (FIG. 2) are interconnected to complete the signal and power line paths throughout the guidance computer. The interconnecting paths between boards is provided on two sides of the package by providing each printed circuit board 156–172 (FIG. 14) with recessed right angle printed circuit board connections 182 and 184 whose connector pins 186 are interconnected by flexible leads mounted upon a suitable flexible insulating plastic support, such as polyethlene plastic sold under the Trademark KAPTON. Interfacing with the gyro-optical assembly is done at the forward end and interfacing with the power and control system is done at the rear end of the electronics section 18.

Figure 15:
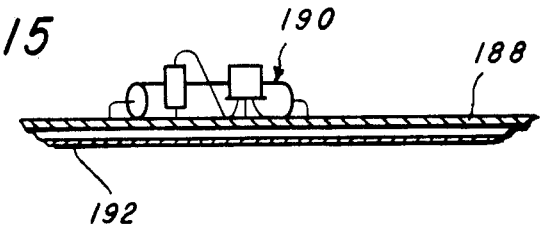
FIG. 15 is a cross sectional view of a completed printed circuit board.
Figure 16:
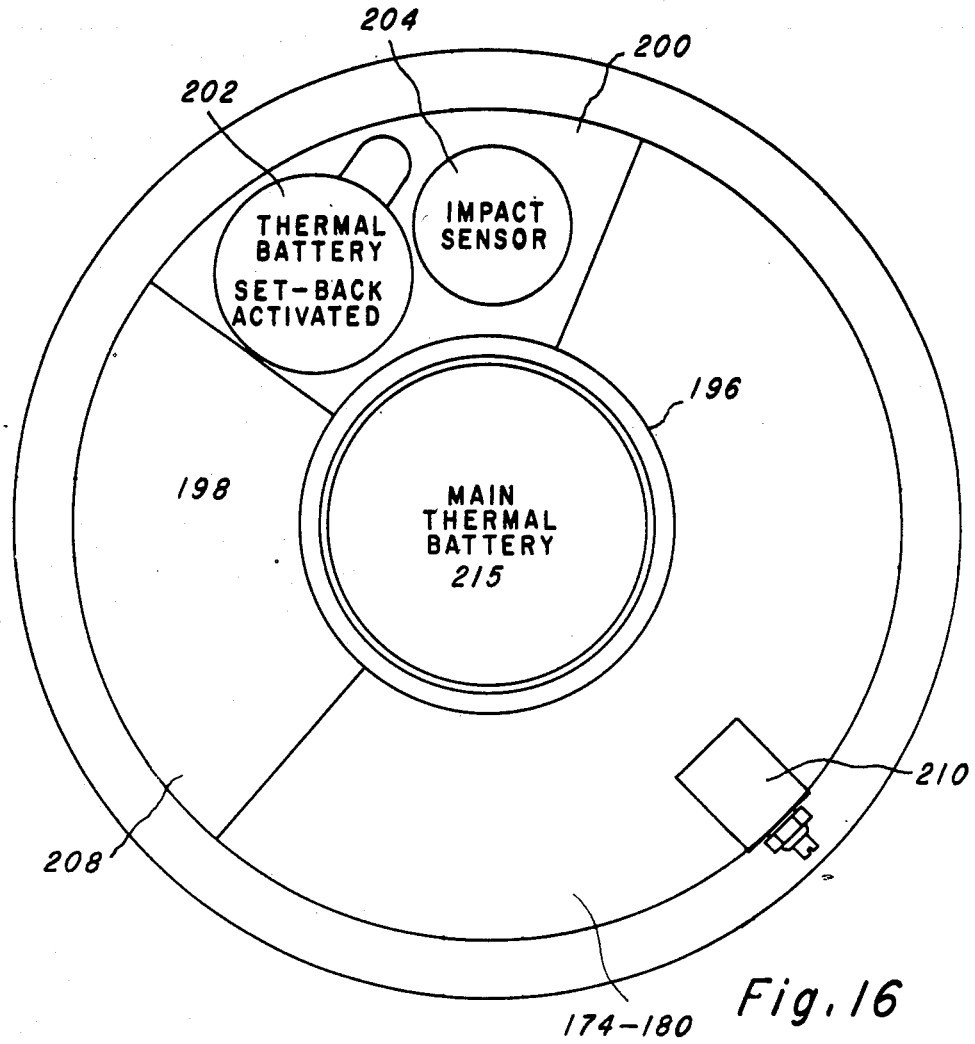
FIG. 16 is a rear view of the electronics section.

The printed circuit boards 156–172 (FIG. 15) are circular double sided copperclad fiberglass sheets 188 with the circuit pattern etched on one side only and the components 190 attached to the other side. After a printed circit board is loaded with its components a thin (about 0.015 inch) copperclad fiberglass board 192 is bonded to the etched side to provide further protection against cross coupling between circuits. The board is mounted so that the fiberglass side of the board is facing the etched pattern side of the printed circuit board. The copperclad side forms a ground plane bond. The remaining printed circuit boards 174–180 are semicircular shaped boards which are positioned behind the electronics section bulkhead 154 and extend halfway around a centrally disposed cylindrical section 196 (FIGS. 2 and 16). The cylindrical section 196 has one end secured to the bulkhead 154.

In addition to the semicircular printed circuit board module and cylindrical section 196, a section 200 (FIG. 16) for a small "set back" activated thermal battery 202 and impact sensor 204 completes the electronics section 18 aft of the bulkhead 154. A main thermal battery 215 is mounted in the centrally disposed cylindrical section 196 with its center line coinciding with the longitudinal axis of the projectile. A timer adjustment 210 for a variable delay timer 226, hereinafter described, is mounted in the surface of the electronics section and completes the electronics package 18.

Figure 17:
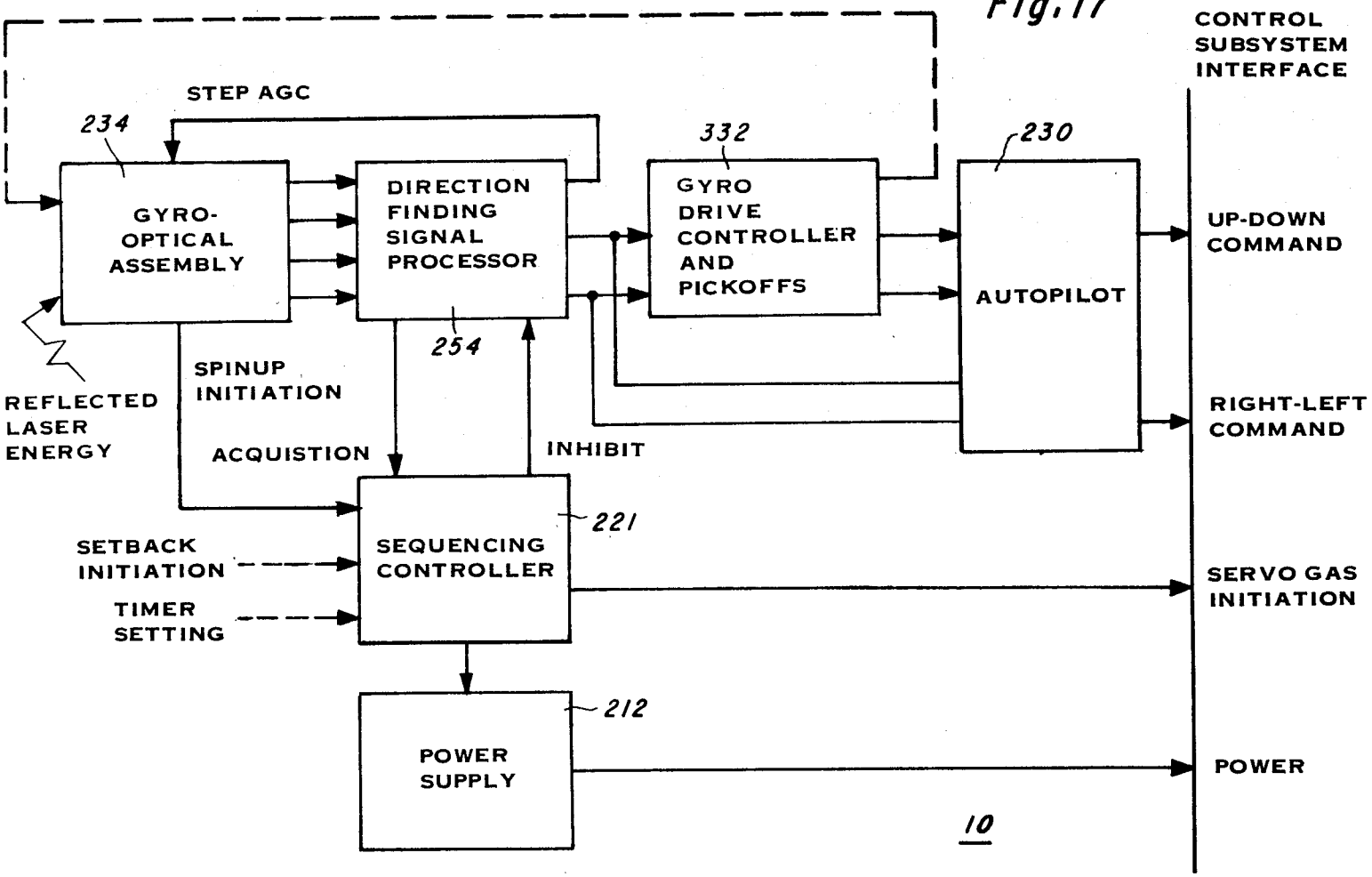
FIG. 17 is a simplified block diagram of the guidance system.

The electrical power supply 212 for the projectile (FIG. 17) includes; the small thermal battery 202 (FIG. 18*d*), equipped with a White starter (not shown); a main thermal battery 215, equipped with an electrical ignition circuit or match 214; and an integrated circuit containing voltage regulators 216 and converter 218—to maintain the outputs of the battery 215 at usable levels for the guidance electronics, hereinafter described. Because the batteries are not rechargeable, a diode decoupling circuit 220 is provided to isolate the batteries from the system during tests made on external power. This decoupling circuit 220 also protects activation device circuits 222 of the gas supplies for the gyro and control servo actuators 30 (FIG. 1).

Figure 18A:
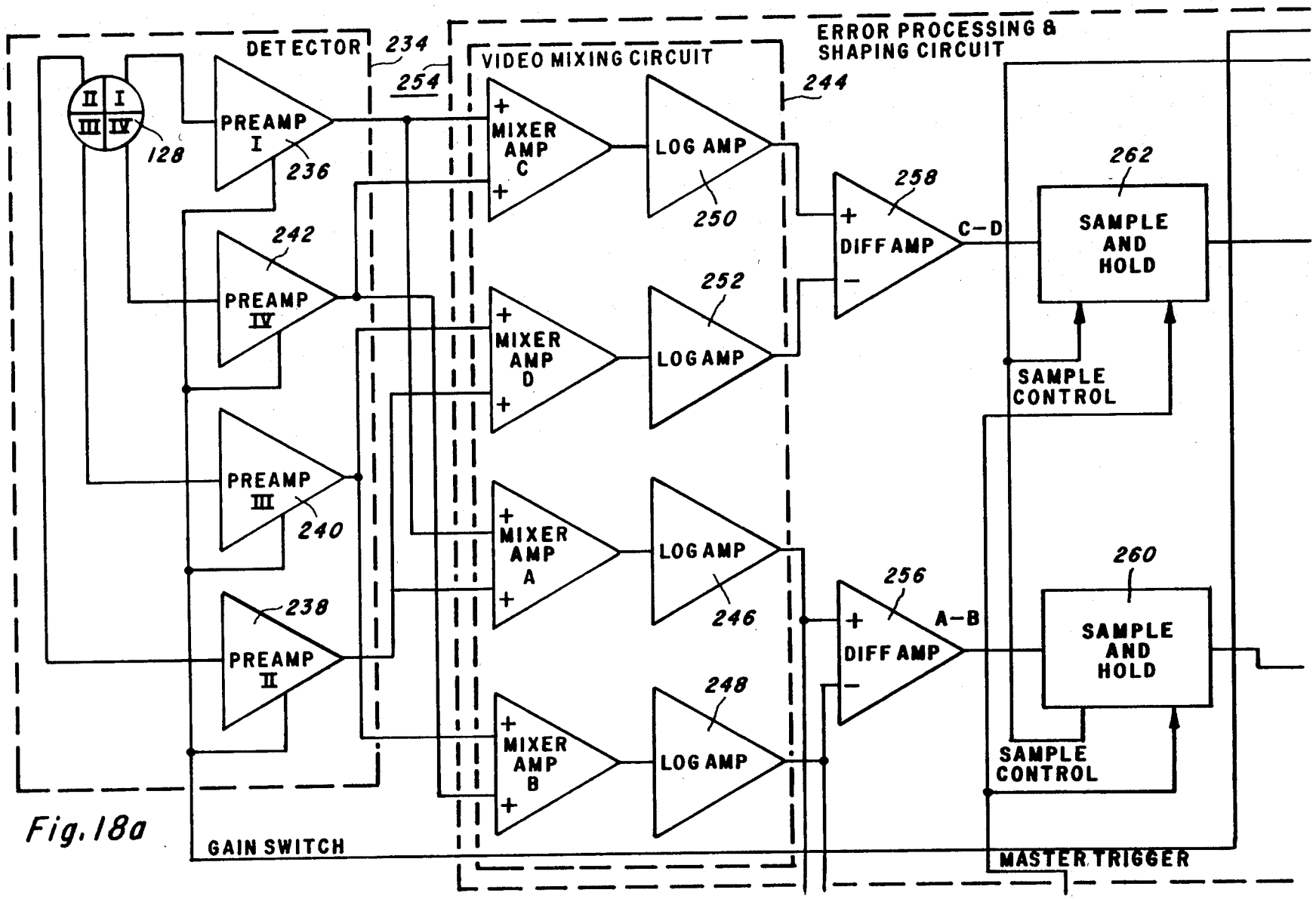
Figure 18B:
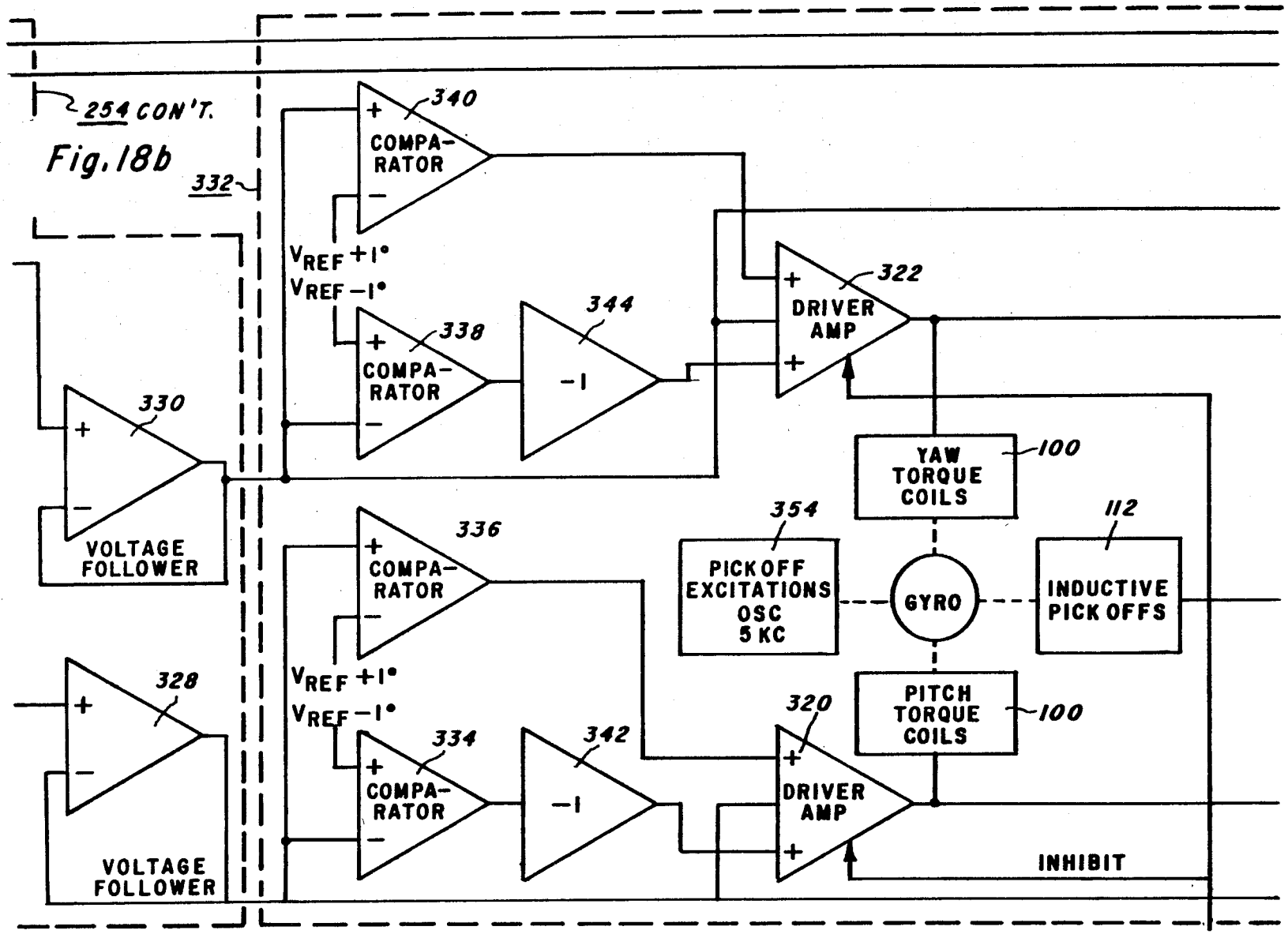
Figure 18C:
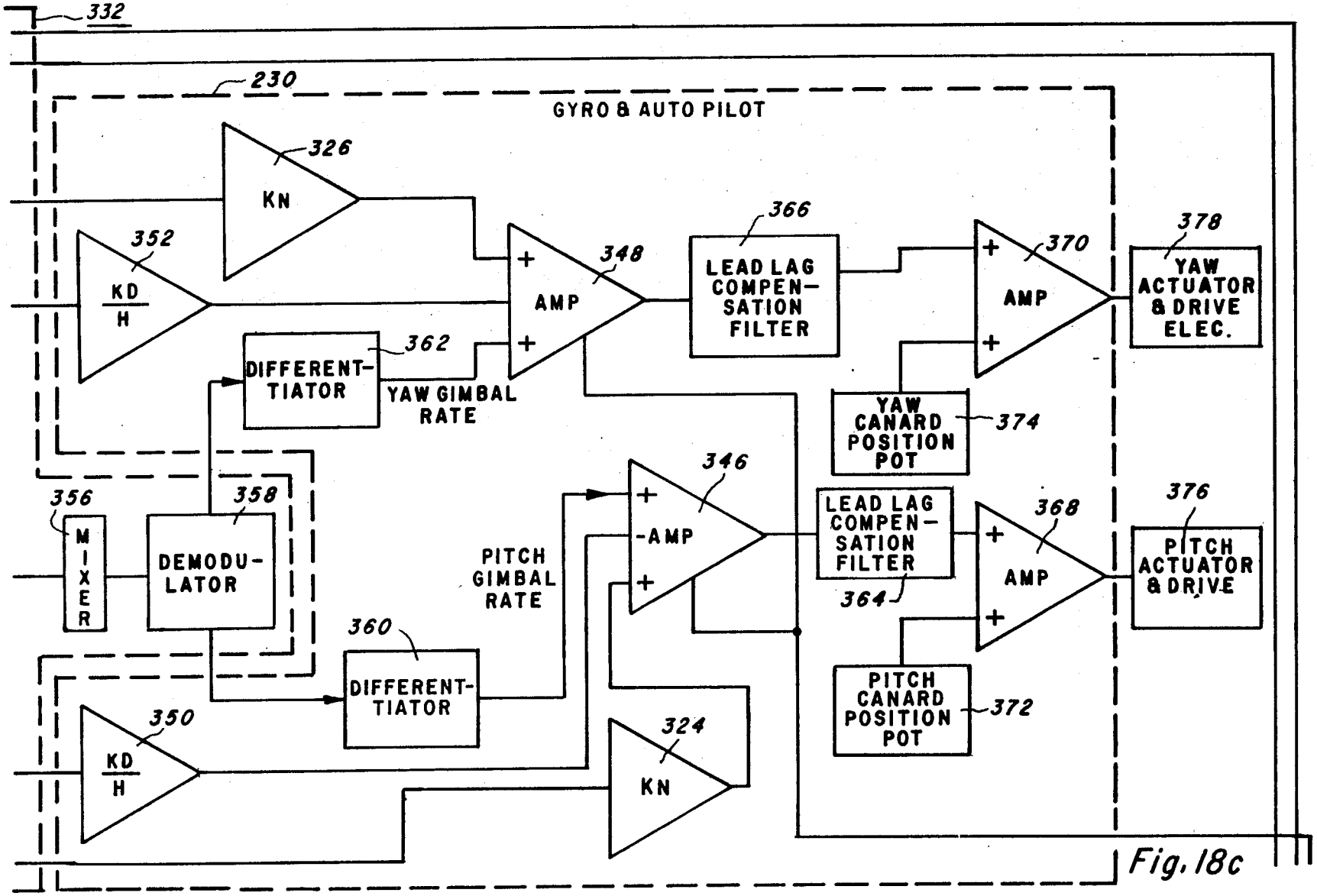
Figure 18D:
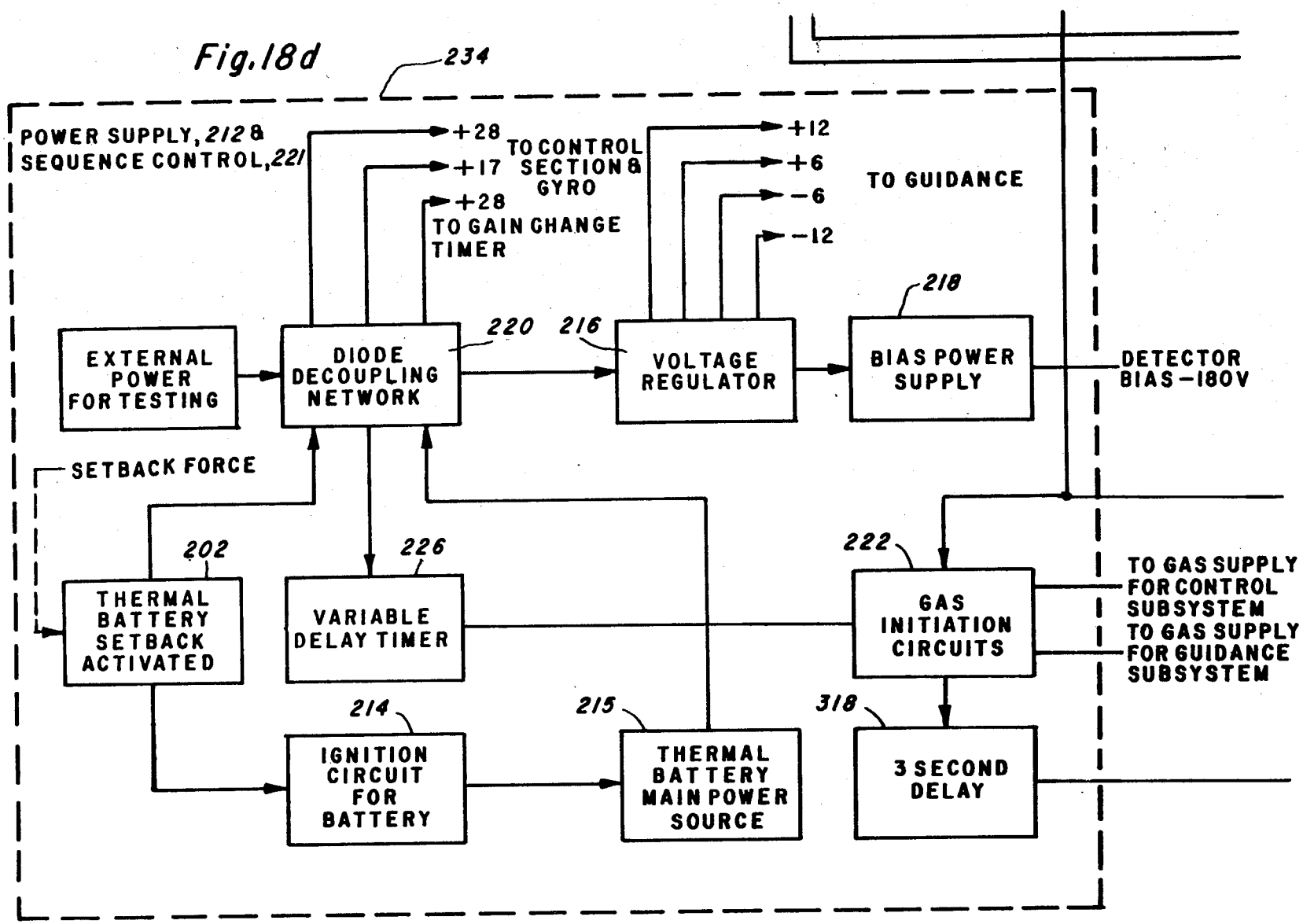

The operation of the guidance system is controlled by a sequence controller 221 (FIG. 17) which includes a variable delay timer 226 (FIG. 18*d*). When the projectile is fired, "setback" occurs as a result of the acceleration force. The first small battery 202 is activated at "setback" by the White starter (not shown) to provide power to the variable timer 226 (FIG. 18*d*) for timing (about 8 to 30 seconds) the unguided portion of the flight, and to an electrical match 214 (FIG. 18*d*) to ignite the main thermal battery 215. After timer cycle 226 the battery 202 output is supplied through a diode decoupling network 220 to provide unregulated voltages to the control section 16 (FIG. 1), and to the gyro optical assembly section 20 for squib detonation (not shown) to release gas for servo and gyro operations respectively. When the battery 215 has reached its rated output it will shut-off the electrical match or ignition circuit 214. The dc current of the battery 215 is then fed through a voltage regulator 216 (FIG. 18*d*) to provide ±12 V and ±6 V dc power to the guidance system, and through a dc to dc converter 218 to produce a −180 dc volts to bias the detector 128 (FIG. 18*a*).

Figure 18E:
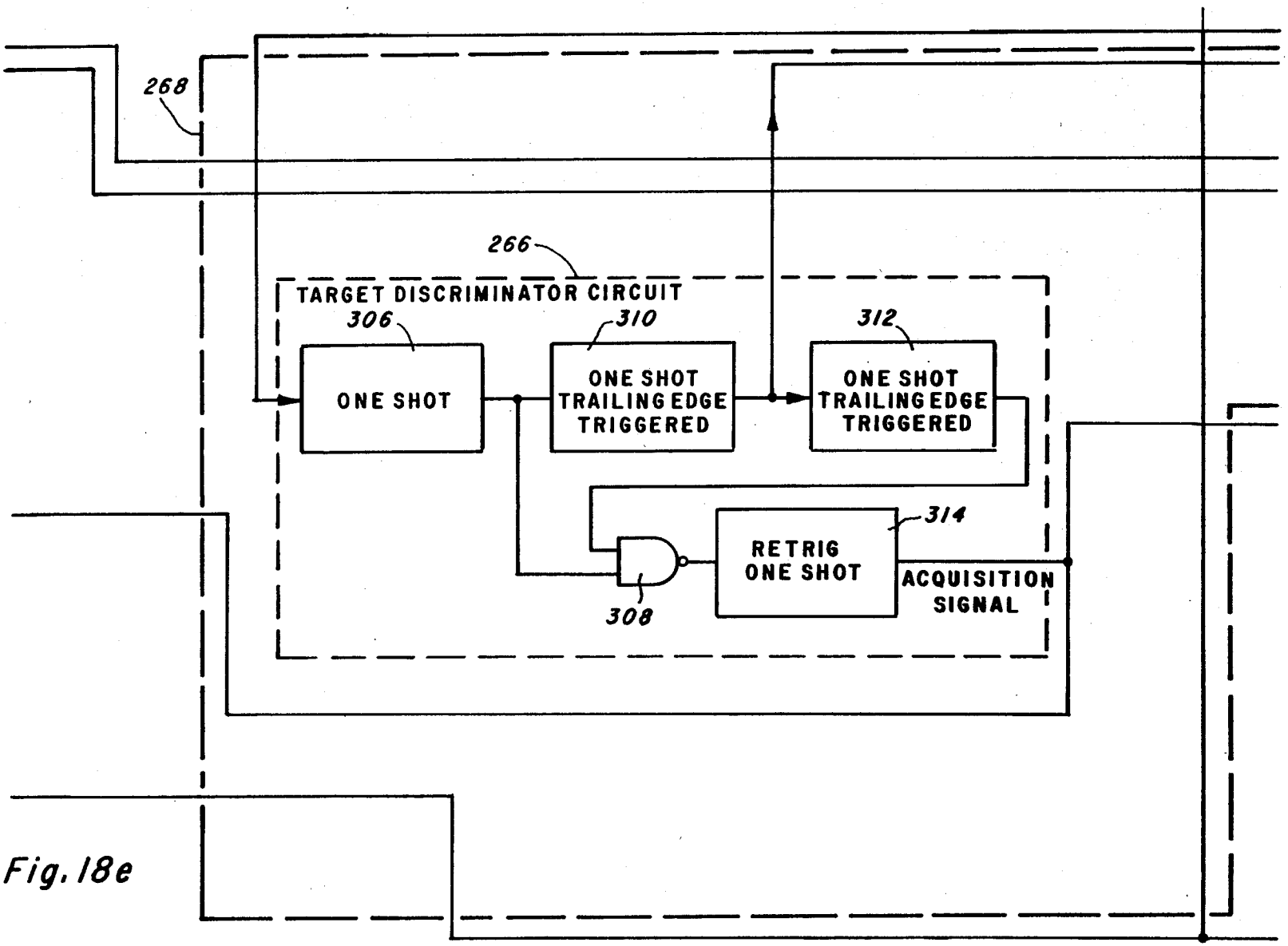
Figure 18F:
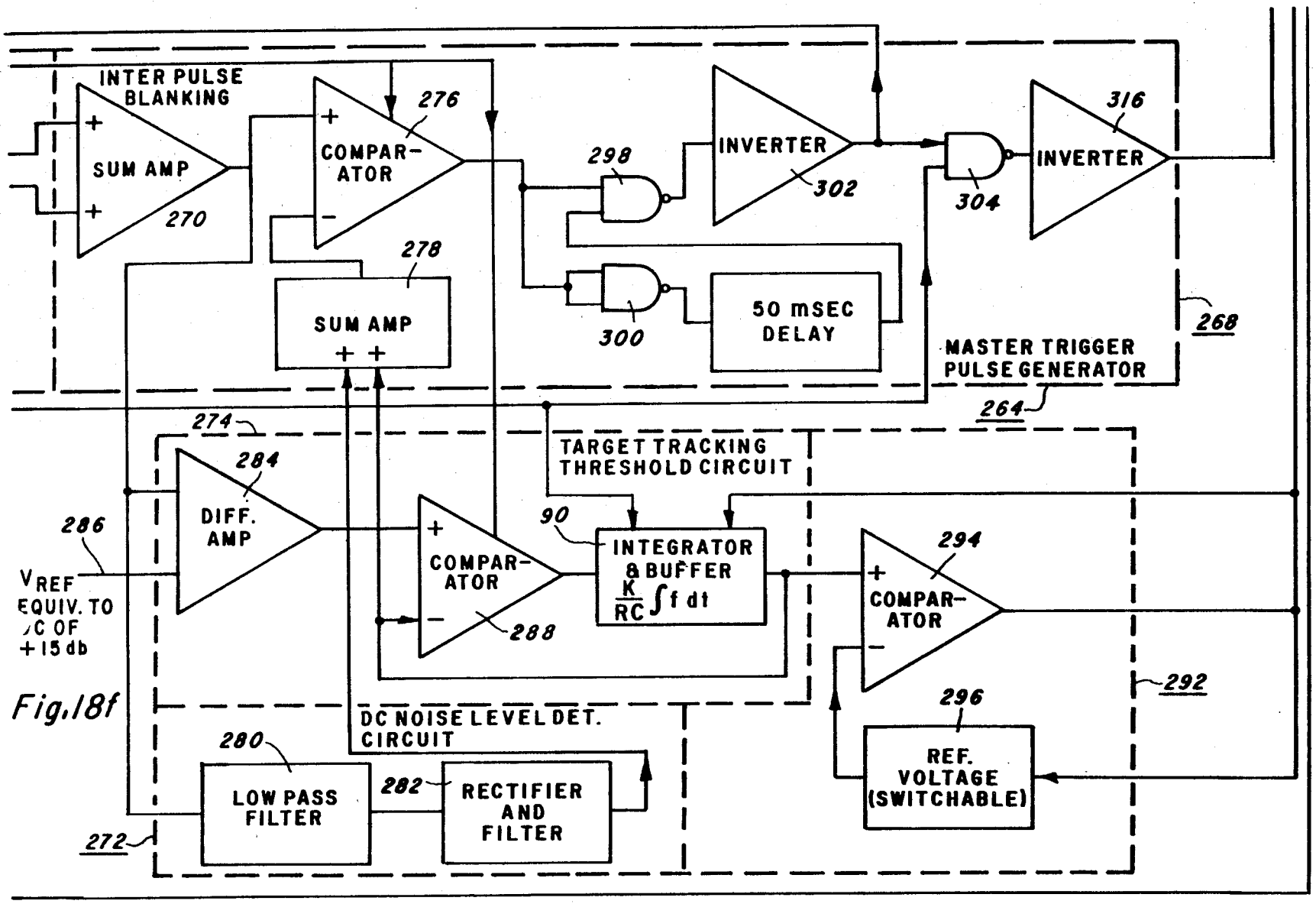

Power from the main thermal battery 215 (FIG. 18*d*) activates the direction finding signal processor 254 (FIG. 17) during flight to begin "listening" for reflected laser signals emanating from a target. The direction finding signal processor 254 receives from the gyro optical assembly 234 amplified electrical signals indicative of the targets position for processing two projectile directional error signals. These amplified signals originate from the energy of reflected laser light passing through the dome 38, lens/filter 78 and striking any or each of the four quadrants I, II, III, and IV of detector 128 (FIG. 12). The detector 128 (FIG. 18*a*) converts the light energy (photons) striking each quadrant I–IV to electrons which are collected and amplified by four preamplifiers 236, 238, 240 and 242—one for each quadrant I–IV. The preamplifier signals are fed to mixers A, B, C, and D of video signal mixing and amplification circuits 244 as follows: the signals from preamplifiers 236 and 238 are inputs to mixer amplifier A; the signals from preamplifiers 240 and 242 are inputs to mixer amplifier B; the signals from preamplifiers 236 and 242 are to mixer amplifier C; and the signals from preamplifiers 238 and 240 are to mixer amplifier D. In this manner the error for the pitch and yaw axes can be determined by comparison with the opposing pair of signals. The mixers may be any commercially available mixers; however, they must be closely matched with one another to provide accurate sighting when the blur spot is centered on the dead zone 140 of detector 128, and have close linearity over four orders of magnitude of input signal dynamic range. As the signals from mixed amplifiers A, B, C, and D are nonlinear they are fed to corresponding log amplifiers 246, 248, 250, and 252 which compress the dynamic range by amplifying weak signals and attenuating strong signals in proportion to the strength of the signals. Logarithmic amplification has the effect of removing signal intensity factor variations from the error processing since subtraction of logarithmic signals has the same effect as division. The outputs of the log amplfiers 246–252 are applied to a target finding error processing and shaping circuit 254 (FIGS. 18*a* and 18*b*) to produce pitch and yaw error signals. The error processing and shaping circuit 254 includes pitch and yaw difference channels comprising two difference amplifiers 256 and 258 (FIG. 18*a*) which receive the outputs of log amplifiers 246 and 248, and log amplifiers 250 and 252, respectively, and determine the off target angle from the relative percentage of signal amplitude input. Once the difference amplifiers 256 and 258 have responded to the video mixing circuits 244, the quadrant resolution is completed. The pulse outputs of the difference amplifiers are then applied to sample and hold circuits 260 and 262 respectively for pulse stretching. The sample and hold circuits 260 and 262 also receive as control inputs a master trigger pulse and a target acquisition signal from a trigger pulse generator 264 (FIG. 18*f*) and a target discrimination circuit 266 (FIG. 18*e*) of a sum channel 268 (FIGS. 18*e* and 18*f*). The master trigger pulse time samples for the sum channel the pulse error signal after the leading edge of the error pulse has occurred. If the acquisition signal is lost the voltage on the sample and hold circuits (FIG. 18*a*) is returned to a zero command state and no signals are supplied to the gyro and autopilot 230 (FIG. 18*c*).

The sum channel 268 (FIG. 18*e* and 18*f*) includes a summing amplifier 270 (FIG. 18*f*) for summing the detector based outputs of log amplifiers 246 and 248 (FIG. 18*a*). The detector based outputs of the summing amplifier 270 (FIG. 18*f*) are fed to a dc noise level determining circuit 272; a target tracking threshold circuit 274, and to one input of a comparator 276 having as its other input the output of a summing amplifier 278. Summing amplifier 278 sums the output of the noise level determining circuit 272 and the target tracking threshold circuit 274 to control input to the trigger pulse generator 264 and to the target discrimination circuit 266 (FIG. 18*e*).

When the projectile is far from the target, the detector 128 (FIG. 18*a*) will pick up a low level noise; the noise level determining circuit 272 (FIG. 18*f*) comprises a low level filter 280 which passes low frequency signals to a rectifier 282 for conversion to a dc level. The dc voltage is applied to one terminal of the summing amplifier 278. The other terminal of summing amplifier 278 receives the output of the tracking threshold circuit 274 which comprises a difference amplifier 284 for differencing the detector based outputs of the summing amplifier 270 and a reference voltage 286 used to establish a target threshold level sufficient to eliminate secondary targets—such a voltage, for example, is equivalent to a dc voltage of +15 db. The difference signal of the difference amplifier 284 is fed to a comparator 288 where it is compared with the output of an integrator and buffer circuit 290. The integrator and buffer circuit 290 receives the output of the comparator 288 for integration pursuant to logic control signals obtained from the acquisition signal output of the target discriminator circuit 266 (FIG. 18*e*) and a gain switch circuit 292. As the target is approached, the noise level increases and the integrator follows the signal at a threshold level which will eliminate detection of secondary targets. The gain switch circuit 292 is necessary to cover the dynamic range of the detector response to reflected laser energy and to discriminate target reflected energy from other reflected sources on the basis of signal. Thus the output of the integrator and buffer circuit 290 is also fed to a comparator 294 where it is compared with a switchable reference voltage 296 to switch the operating level of the preamplifiers 236–242 (FIG. 18*a*) to accommodate high-intensity signals without saturation.

The master trigger pulse generator 264 (FIG. 18*f*) receives from the comparator 276 any frequency signal above the level of the target threshold voltage; this signal is applied to one input terminal of a first NAND gate 298 and to both input terminals of a second NAND gate 300. The output of the second NAND gate 300 provides a delayed signal to the other input terminal of the first NAND gate 298; the resulting output is a number of very small (50 nsecs) inverted trigger pulses which are phase inverted by inverter 302 and fed as one input to a third NAND gate 304 and to a one shot multivibrator 306 (FIG. 18*e*) of the target discrimination circuit 266. The one shot multivibrator 306 stretches the trigger pulse width of the trigger pulses a desired amount. The output of the multivibrator 306 is applied to one input terminal of acquisition NAND gate 308 and to a second one shot multivibrator 310 which is triggered by the trailing edge of the output signal to produce a trigger pulse which is substantially longer in duration than the pulse of the multivibrator 306. This multivibrator 310 provides two outputs—the first output is the interpulse blanking or inhibitor signal applied to comparator 276 (FIG. 18*e*) to inhibit the master trigger pulse generator 264 from producing trigger pulses during its application and to the comparator 288 for controlling the output of the tracking threshold circuit; the second output is to a third one shot multivibrator 312 (FIG. 18*e*) which is triggered by the trailing edge of the pulse to provide a pulse of duration intermediate the outputs of the other two one shot multivibrators 306 and 310. This multivibrator 312 is referred to as the window gate because its output is the second signal to NAND gate 308 which enables any trigger pulse signal to pass during its pulse period to a retriggering one shot multivibrator 314. If a signal is detected acquisition is achieved. The acquisition pulse turns on the one shot multivibrator 314 for a period sufficient to receive a desired number of acquisition pulses. The receipt of one pulse during this period retriggers the multivibrator 314; failure to receive a second pulse during this period results in the loss of the acquisition signal.

The acquisition signals of the target discrimination circuit 266 (FIG. 18*e*) are fed to four branch circuits. In one branch circuit the acquisition signal output is fed to the second input terminal of NAND gate 304 of the master trigger pulse generation (FIG. 18*f*); this gate then passes the master trigger pulses through a phase inverter 316 as sample control signal inputs to the sample and hold circuits 260 and 262 (FIG. 18*a*) of the target direction finding signal processor 254 (FIGS. 18*a* and 18*b*). The second branch circuit feeds the acquisition signal to an input terminal of the integrator and buffer circuit 290 (FIG. 18*f*) of the above described tracking threshold circuit 274 to control trigger pulse amplitude. The third branch circuit feeds the acquisition signal directly to input terminals of the sample and hold circuits 260 and 262 (FIG. 18*a*) as control signals. The fourth branch circuit feeds the acquisition signal to the sequence controller 221 (FIGS. 17 and 18*d*) to the gas initiation circuits 222 (FIG. 18*d*) to fire squibs to release gas from the gas supply bottles for the servo control subsystem and the gyro of the guidance system. To enable the servo actuators 30 (FIG. 1) of the control system time to attain full response capability to open the canards 28 fully and to give the gyro time to spin up and uncage, the gas initiation circuits 222 (FIG. 18*d*) provide a short (0.3 seconds) inhibit signal through delay 318 to gyro pitch and yaw driver amplifiers 320 and 322 (FIG. 18*b*), and to the autopilot pitch and yaw output amplifiers 346 and 348 (FIG. 18*c*). With these functions described the description of the sum channel 268 is completed.

Returning to the target direction finding signal processor electronic circuit 254 (FIGS. 18*a* and 18*b*) and in particular to the sample and hold circuits 260 and 262 (FIG. 18*a*) to continue with the description, when target acquisition is maintained, the outputs of the sample and hold circuits 260 and 262 are applied to voltage followers and filter amplifiers 328 and 330 (FIG. 18*b*) for transmittal to gyro control electronic circuits 332 (FIG. 18*c*).

The gyro control electronic circuits 332 include pitch and yaw error sensing comparators 334 and 336, and 338 and 340 respectively coupled to the outputs of voltage followers 328 and 330 of the error processing and shaping circuit 254 for determining whether the pitch and yaw angles to target exceed plus or minus one degree from the gyro spin axis. The outputs of comparators 334 and 338 are applied to inverters 342 and 344 for phase inversion after comparison with a reference voltage equivalent to a minus one degree and found to be above the lower limit. The outputs of inverters 342 and 344 are applied to pitch and yaw driver amplifiers 320 and 322 respectively, as are the outputs of the positive comparators 336 and 340 if their positive values are within the upper limits of one degree. The outputs of the pitch and yaw driver amplifiers 320 and 322, after the 0.3 second delay for gyro spin up, are applied to the pitch and yaw torquers 100 for precession of the gyro. If the pitch and yaw angles exceed plus or minus one degree from the gyro axis the outputs of the voltage followers 328 and 330 are directly to the pitch and yaw driver amplifiers 320 and 322 respectively, and to pitch and yaw amplifiers 324 and 326 (FIG. 18*c*) for the autopilot 230. The pitch and yaw signal output of amplifier 324 and 326 are applied at one input to pitch and yaw driver amplifiers 346 and 348 respectively for the autopilot 230. The outputs of driver amplifiers 320 and 322 (FIG. 18*b*) for the gyro torquers 100 are inverted by inverters 350 and 352 (FIG. 18*c*) and applied to the negative input terminals of the pitch and yaw driver amplifiers 346 and 348.

To determine the gyro response to the torquers the primary coils of the gyro pickoffs 112 (FIG. 18*b*) are excited by an excitation oscillator 354 and voltages are induced in the secondary windings in proportion to the angular position of the rotor with respect to the state of the pickoffs. The secondary circuits of each pickoff set form opposite pole pairs and as previously described are connected in series opposition. Thus the voltages in the secondary circuit or inductive coils are opposite in phase, and the output of each pickoff is the difference of the induced voltages. The outputs of the gyro pickoffs 112 are applied to a resistive mixer bridge 356 (FIG. 18*c*) which is used to decouple the signals from the pickoffs. Decoupling is necessary because the pickoffs are mounted at 45° (FIG. 7) from the gimbal torque axes and will sense precession from both torquers. The outputs of the mixer bridge 356 are applied to a demodulator 358. The demodulator circuit requires a reference phase which can be supplied as the opposite phase of the oscillator 354 (FIG. 18*b*). The oscillator 354 may be any standard astable oscillator. The output of the demodulator 358 (FIG. 18*c*) may be through a low pass filter (not shown) to provide additional shaping of the signal. The output of the demodulator is fed to pitch and yaw differentiators 360 and 362 of the autopilot 230. The outputs of the differentiators 360 and 362 establish the pitch and yaw gimbal rates and are applied to other positive input terminals of amplifiers 346 and 348, respectively. The outputs of amplifiers 346 and 348 are passed through lead and lag compensation filters 364 and 366, respectively, to difference amplifiers 368 and 370, respectively, where they are compared with pitch and yaw canard position signals taken from pitch and yaw canard position potentiometers 372 and 374. The difference signals which have polarities indicative of the desired canard position changes are applied to pitch and yaw actuator and drive electrodes 376 and 378 controlling the gas actuated servo actuators 30 which manipulate the canards to guide the projectile.

The above mentioned electronics are packaged on the printed circuit boards 156–180 (FIG. 2) as follows. The printed circuit board 156 (FIG. 2) interfaces the electronics system with the gyro-optical system 234 (FIG. 17) to bring the outputs of the detector signal preamplifiers 236–242 (FIG. 18*a*) back to the video mixing and amplifying circuits 244 formed in printed circuit boards 158 and 160 (FIG. 2) where signal compression and processing begins. The interfacing board 156 also handles the power for the preamplifiers 236–242, the gyroscope torquers 100 and pickoffs 112 (FIG. 18*b*), and the detector 128 (FIG. 18*a*). The outputs of the video mixing and amplifying circuits 244 are connected to the target finding signal processor 254 (FIGS. 18*a* and 18*b*) formed on printed circuit board 162 (FIG. 2), which also receive the acquisition signals and master trigger pulses from the summing circuit 268 (FIGS. 18*e* and 18*f*) contained in printed circuit board 164 (FIG. 2). The dc noise level determining circuit 272 (FIG. 18*f*) and the target threshold circuit 274 are also contained on printed circuit board 164. The outputs of the sample and hold circuits 260 and 262 (FIG. 18*a*) of the target finding signal processor 254 are to gyroscope drive controller and pickoff electronics 332 (FIG. 17) formed on printed circuit board 164. The autopilot 230 (FIG. 18*c*) is housed on printed circuit board 168 for flying the projectile responsive to the outputs of the gyroscope drive controller and pickoff electronics 332 (FIG. 18*b*). The servo actuator driver circuits (FIG. 18*e*) are formed on printed circuit board 170 (FIG. 2). The diode decoupling network 220 and voltage regulators 216 (FIG. 18*d*) of the power supply 212 (FIG. 17) are housed on printed circuit board 172; this board is the last full circular shaped board of the system. The remaining semicircular boards 174–180 contain electronics as follows. A dc-to-dc voltage converter 218 (FIG. 18*d*) for the detector bias supply is formed on printed circuit board 174 (FIG. 2). Ignition or gas initiation circuits 222 (FIG. 18*d*) for igniting the gas container firing squibs are formed on printed circuit boards 176 (FIG. 2). The variable switch 214 (FIG. 18*d*), which may be a twelve position switch, is housed on printed circuit board 178 (FIG. 2). Interfacing with the control section is done on the last printed circuit board 180 (FIG. 2).

The operation of the guidance system is summarized as follows. When the projectile is fired "set back" occurs to actuate a small battery in the power supply 212 (FIG. 17) to power the sequence controller 221 which includes a variable timer for activating a main battery to provide power to the projectile guidance system at a desired time prior to impact. The main battery powers the detector of the gyro optical assembly 234 and the direction finding signal processor 254 to acquire target acquisition. If target acquisition is achieved the sequencing controller 221 is signaled and gas initiating circuits are powered to fire squibs to release gas to uncage and spin up the gyroscope and to enable the servo actuator. A built in time delay inhibits the gyro pickoff signals reaching the servo actuator controllers for a short time to permit the guidance system to reach normal operating conditions. This completes the functions of the sequence controller. After removal of the inhibit signal, the gyro optical assembly continues to send target position information to the direction finding signal processor 254. The direction finding signal processor sends target seeking information (pitch and yaw signals) to the gyro drive controller and pickoff circuitry 332 and in particular to gyro torquers which precess the gyro rotor to align the lens of the optical assembly with the target, and to the autopilot for guiding the missile. Information concerning the position of the gyro rotor relative to the projectile's flight is obtained from the gyro pickoffs and applied to the autopilot 230 for nutation compensating the pitch and yaw signals and for comparison with the pitch and yaw projectile guidance signals. Command signals emanating from the autopilot 230 are applied to the servo actuators which manipulate the projectiles canards in response to the command signals to bring the projectile and the gyro optical system into alignment with the spin axis of the gyro, thereby to align the projectile to the target.

Although preferred embodiments of the present invention have been described in detail, it is understood that various changes, substitutions, and alterations can be made therein without departing from the scope of the invention as defined by the appended claims.

What is claimed is:

1. A method for guiding to a target a cannon launched guided projectile having a timer, stabilizing fins, a direction finding signal processor electronic means, a gyro-optical system, a gyro, an electrical drive means and projectile guidance means comprising:

(a) activating the timer upon setback to time an unguided portion of the projectile's trajectory;

(b) deploying the stabilizing fins during the unguided portion of the projectile's trajectory to stabilize the projectile against spin;

(c) sequentially activating the direction finding signal processor electronic means to determine, responsive to signals generated by the gyro-optical system, target acquisition, while delaying the output of projectile guidance signals of the processor electronic means and during the delay, activating the gyro of the gyro-optical system and the projectile guidance means;

(d) precessing the gyro through pitch and yaw signals received from the direction finding signal processor to align the gyro with the target;

(e) providing pitch and yaw angle signals from the direction finding signal processor electronic means for producing pitch and yaw guidance signals; and (f) applying the pitch and yaw guidance signals to an electrical drive means to selectively actuate the projectile's guidance means to align the projectile with the target.

2. A cannon launched guided projectile comprising:

(a) a housing having a fin stabilizing end, and a nose cone end, separated by a payload section, a guidance control section and an electronics section;

(b) stabilizing fins pivotally attached to the stabilizing end, said fins being flush with the housing and deployed responsive to centrifugal force when exiting a cannon to stabilize the projectile against spin;

(c) a gyro-optical system mounted in the nose cone end having an optical system including a quadrant detector having its center located on the longitudinal axis of the projectile, said optical system being operative responsive to pulsed laser light energy reflected from a target, said detector being operative to produce electrical target position indicating signals, and a gyroscope, said gyroscope supporting said optical system, and including torquers and pickoffs;

(d) a direction finding signal processor electronic means responsive to the electrical signals of the optical system to precess the gyroscope into target alignment and to produce projectile guidance signals;

(e) an electrically controlled driving means responsive to the projectile guidance signals to selectively activate the projectile guidance means to guide the projectile to the target; and (f) a payload in the payload section, said payload being explosively responsive to impact forces.

3. An automatic guidance system for a movable device comprising:

(a) a housing adapted to admit pulsed laser light reflected from a target;

(b) a lens supported in the housing for focusing said pulsed laser light entering the housing;

(c) a quadrant detector having its center located on the longitudinal axis of the projectile, said quadrant detector being supported in said housing in the path of the focused pulsed laser light such that a spot is formed to generate electrical signals indicative of the position of the focused pulsed laser light spot on the quadrant detector;

(d) circuit means responsive to the detector's electrical signals for developing error correcting signals; and (e) an electrically controlled drive means connected to the circuit means for controlling movement of the device in response to the error correcting signals.

4. In a cannon launched guided projectile having a nose cone end, fin stabilizers at the other end, and electronically controlled guidance canards therebetween, a gyro-optical assembly mounted in the nose-cone end for providing target direction finding and error information signals to the electrically controlled guidance canards comprising:

(a) a dome mounted in the nose cone for admitting pulsed laser light reflected from a target into the nose cone;

(b) a gyroscope having a stator rigidly secured to the nose cone, a rotor supported by the stator, and a plurality of gyro torques and pickoffs in operative association with said rotor;

(c) a filter in the path of the reflected pulsed laser light for passing the pulsed laser light energy of a target indicating wavelength while attenuating light of other wavelengths;

(d) a lens mounted in the gyro rotor in the path of the pulsed laser target indicating light for focusing the pulsed laser light; and (e) a stationary detector assembly including a housing having a light admitting window at one end and a quadrant detector having its center located on the longitudinal axis of the projectile, said quadrant detector attached at the center of the stator a distance from the lens to receive the focused pulsed laser light as a target indicating spot, said detector operative responsive to the spot for generating electrical signals indicative of the spot location to produce error correction signals for the torquers.

5. An optical system for a guidance system comprising:

(a) a carrier having a longitudinal axis and a bulkhead transversely positioned as to the longitudinal axis;

(b) a lens for focusing received pulsed laser light; and (c) a stationary quadrant detector means including a lens support for the lens, and a pulsed laser light responsive detector rigidly attached to the bulkhead with its center on the longitudinal axis of the carrier in the path of the focused pulsed laser light to receive the focused pulsed laser light as a spot and to generate signals indicative of the spot location on the detector.

6. An optical system according to claim 5 further including a filter positioned in front of the lens to pass light of a desired wavelength to the lens.

7. An optical system according to claim 6 further including a housing for the filter lens and detector means, and a dome positioned to admit light to the filter.

8. An optical system for a guidance system comprising:

(a) a carrier having a longitudinal axis;

(b) a lens for focusing received pulsed laser light; and (c) a stationary quadrant detector means including a pulsed laser light responsive detector positioned with its center on the longitudinal axis of the carrier in the path of the focused pulsed laser light to receive the focused pulsed laser light as a spot and to generate signals indicative of the spot location on the detector and wherein the detector means comprises an elongated ring, a window hermetically sealed in one end of the elongated ring in the path of light passing through the lens, and a detector support hermetically closing the other end of the elongated ring and supporting the detector within the hermetically sealed ring.

9. In a cannon launched guided projectile having a nose cone at a first end, fin stabilizers at a second end, and electronically controlled canards therebetween, a gyro-optical assembly mounted in the nose-cone end for providing target direction finding and error information signals to the electronically controlled guidance canards comprising:

(a) a dome mounted in the nose cone for admitting light reflected from a target into the nose cone, said dome being a diverging meniscus shaped window having an outside radius of 1.425 inches and an inside radius of 1.225 inches both measured from the detector, and a refractive index of 1.586;

(b) a gyroscope having a stator rigidly secured to the nose cone, a rotor supported by the stator, and a plurality of gyro torquers and pickoffs in operative association with said rotor;

(c) a filter in the path of the reflected light passing light energy of a target indicating wavelength while attenuating light of other wavelengths;

(d) a lens mounted in the gyro rotor in the path of the target indicating light for focusing the light, said lens being a plano-convex aspheric lens having a planar side 1.025 inches from the detector and an aspheric surface having a basic curve radius of 0.5676 inches and aspheric terms of $f4=0.143063$ and $A6=5.37103$, and has a refractive index of 1.586 and having the filter formed on the planar side away from the detector; and (e) a detector assembly including a housing having a light admitting window at one end and a detector mounted upon a support closing the other end of the housing, said window of the detector assembly being a diverging meniscus window having an outside radius of 0.55 inches and and inside radius of 0.47 inches both measured from the detector and a refractive index of 1.586, said detector located at the center of the stator a distance from the lens to receive the focused light as a target indicating spot, said detector operative responsive to the spot for generating electrical signals indicative of the spot location to produce error correction signals for the torquers.

* * * * *